US005699837A

United States Patent [19]

Desmet

[11] Patent Number: 5,699,837

[45] Date of Patent: Dec. 23, 1997

[54] COMBINED PILE FEEDER CONTROL SYSTEM AND PILE WARP LET-OFF MOTION FOR PILE WEAVING MACHINE

[75] Inventor: Hans Desmet, Koolskamp, Belgium

[73] Assignee: N.V. Michel Van De Wiele, Marke, Belgium

[21] Appl. No.: 647,050

[22] Filed: May 9, 1996

[30] Foreign Application Priority Data

May 11, 1995 [BE] Belgium ..... 09500427

[51] Int. Cl.[6] ..... D03D 39/16

[52] U.S. Cl. ..... 139/102; 139/110

[58] Field of Search ..... 139/102, 110

[56] References Cited

U.S. PATENT DOCUMENTS 4,884,597 12/1989 Tamura et al. ..... 139/102
5,002,095 3/1991 Herrin et al. ..... 139/102
5,058,628 10/1991 Spiller et al. ..... 139/102

FOREIGN PATENT DOCUMENTS 224464 3/1987 European Pat. Off. .
2716282 10/1978 Germany .

*Primary Examiner*—Andy Falik
*Attorney, Agent, or Firm*—Sughrue, Mion, Zinn, Macpeak & Seas, PLLC

[57] ABSTRACT

In a double-gripper weaving machine, intended for weaving plain velvet and carpets, a pile feeder and a combined pile warp beam let-off motion are equipped with a computer in order to calculate the necessary pile warp feed of each operating cycle of the weaving machine and use said calculation as a reference value, both functions pile feeder and pile warp beam let-off motion, being performed directly. The pile warp beam let-off motion has a regulating system consisting of a multi-axis control system provided for one or more pile warp beams.

11 Claims, 4 Drawing Sheets

FIG. 3 PRIOR ART
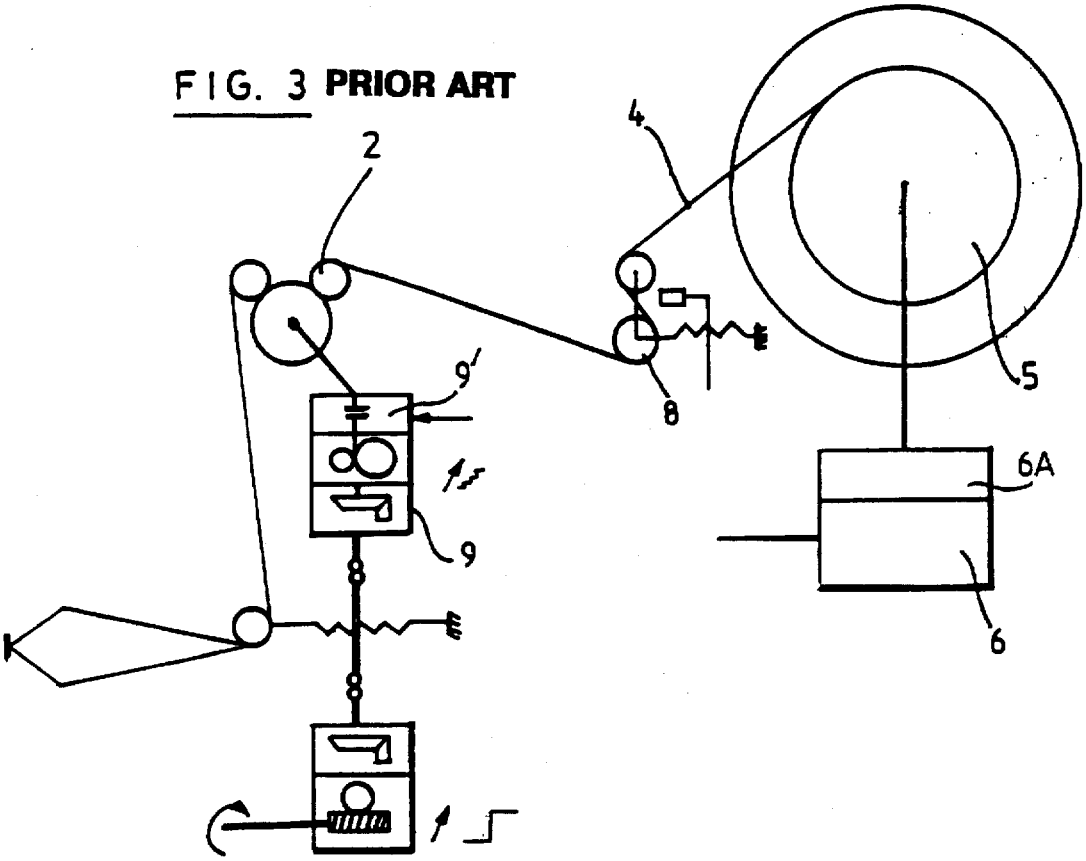
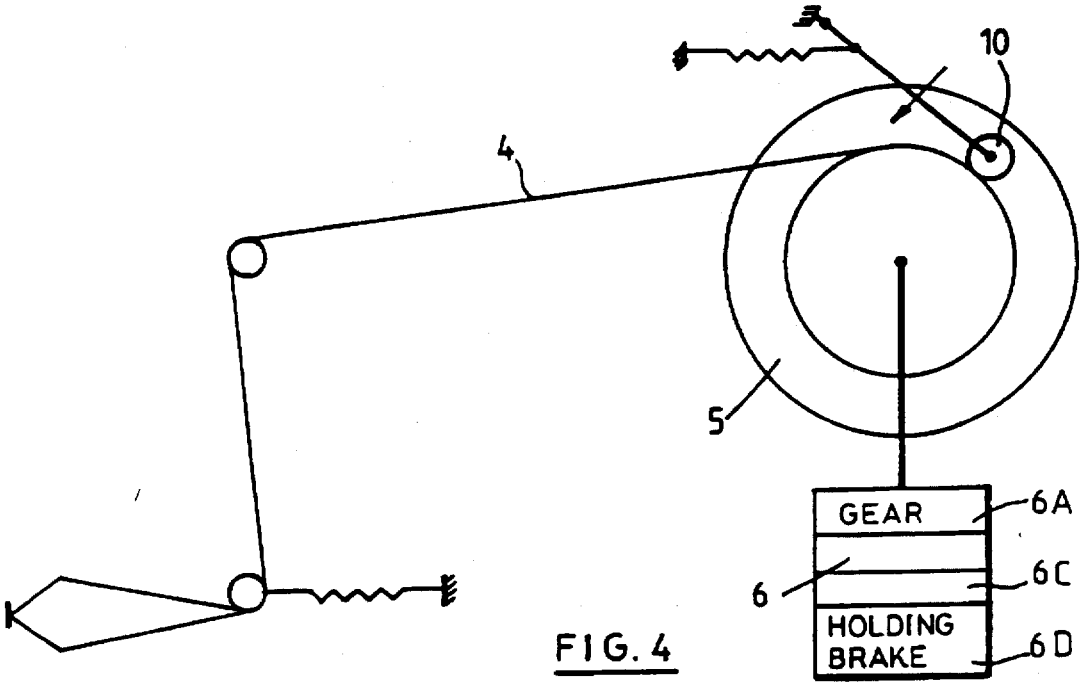
FIG. 4

COMBINED PILE FEEDER CONTROL SYSTEM AND PILE WARP LET-OFF MOTION FOR PILE WEAVING MACHINE

THE PRIOR ART

In the case of face-to-face plain velvet and carpet weaving machines the pile height between top and bottom fabric is determined by the balance arising between the ground warp tension and the pile warp tension. The pile warp is fed into the weaving system by a pile feeder mechanism, and the pile warp is kept at tension with tension springs by means of a swing roller. The pile feeder consists of a set of rollers, the centre roller of which is driven by a pile regulator. The pile warp supply can be set by changing two change wheels in the pile regulator. Such a pile regulator produces a constant pile warp feed.

When a particular design pattern in plain velvet requires little or no pile warp feed, the drive of the pile feeder is interrupted by an electromagnetically controlled gear coupling.

The data for whether or not to control is stored for each shot in the data carrier for the weaving frame motion of the heald loom.

In the weaving machines belonging to the known prior art the use of a computer is limited purely to monitoring the thread supply, and never concerns the control thereof.

Document EP-A-0224464 discloses a method for monitoring thread supply shot by shot during the weaving of pile fabrics, by means of a jacquard weaving loom. The length of a pile thread to be woven is entered in a processor as the reference value. The recorded conveyed thread length is compared with the reference value. During the comparison made, data is supplied as a function of a signal indicating whether the thread must form pile or otherwise.

An alarm signal is emitted if pile thread is not being woven in, or if the thread length being conveyed is outside the set tolerances.

During weaving frame pattern definition for face-to-face plain velvet and carpet, many articles are developed with two or three pile warp systems.

Each of these pile warp systems has its own pile warp beam with pile warp let-off motion, pile feeder roller and gear coupling, but no pile regulator of its own. There is only one common pile regulator for one or more pile warp beams.

Said pile regulator has a set of change wheels for each individual pile warp supply, with a gear coupling for temporary interruption and/or switching on/off of said pile warp supply. In the case of double-gripper weaving machines which rotate more slowly (240 r.p.m.) these devices have worked faultlessly and met the strict quality standards in the field of pile height regularity and stripe formation. In the case of the current highspeed double-gripper weaving machines for plain velvet (320–340 r.p.m.) these devices are no longer adequate for weaving certain velvet articles with several pile warp systems and short-pile single systems. At a stopping/starting point a line mark becomes apparent in the weft direction in the pile surface. This is also the case where two-pile warp systems change in order to form working pile. This line mark is caused by a difference in pile height. It should not be confused with the starting stripe, which is due more to a local change in weft density as the result of a "weaker" starting beat-up of the weaving reed.

This phenomenon indicates that the pile warp beam has not reached speed fast enough; during full weaving speed said pile warp beam has to start from a stationary position and ensure the full pile supply for a few shots, before coming to rest again in the case of pile warp systems with intermittent and/or changing pile warp use. The electromagnetic gear couplings have an electrical and mechanical inertia, with the result that at high speed it is impossible here to switch on and off with sufficient accuracy and for each shot. The pile regulator—pile feeder drive unit is a gear train which ultimately shows considerable play at the periphery of the pile feeder roller: the counter-pile warp tension, caused by the pile beam warp let-off motion reacting too slowly, also has an effect here.

For these reasons, it is purely a matter of trial and error in article development to try and establish precisely at which shot the old pile warp system must be switched off and at which shot the new system must already be switched on. The development time or perfecting of an article with several pile warp systems is therefore very complicated and time-consuming. Besides, for some articles a good result is not obtained in the case of double-gripper weaving machines or at high weaving speeds (320–340 r.p.m.).

In the case of other plain velvet fabrics with a pile warp system, e.g. chiffon and cotton fabric for curtains and ladies' clothing, the pile height is fairly low, and the slightest irregularity in pile warp supply is apparent as a shadow band in the weft direction on the pile surface. In a first examination the following reason was found for this: eccentrically rotating pile warp beams, slightly eccentrically rotating pile feeder rollers, periodic jamming of guide rollers, eccentricities in the pile warp regulator gear train which are the cause of "hard" and "soft" running working points; in short, faults in the mechanical drive steps.

In general, it can therefore be said that, as regards dynamics, a mechanical pile feeder with standard electrically controlled pile warp beam let-off motion does not meet the weaving conditions of a high-speed face-to-face weaving machine. The pile warp is woven faster than the mechanical system—which is limited by its own inertia—can feed in starting and stopping conditions at full weaving speed.

SUMMARY OF THE INVENTION

The object of the invention is to provide an attractive and reliable solution to the problem of too slow a supply from a mechanical pile feeder, and also further greatly to shorten and simplify, and make more flexible, the article change-over time and article development time.

The present invention relates to a pile feeder control system and pile warp let-off motion for a face-to-face weaving machine intended for weaving plain velvet and carpets, comprising a pile feeder and a pile warp beamlet-off motion equipped with a computer suitable for calculating the necessary pile warp feed for each operating cycle of the weaving machine and using said calculation as a reference value.

For this purpose, there is provided a pile feeder control system and combined ground warp let-off motion in which the entire system of mechanical groups, such as pile feeder, pile regulator, gear coupling and pile beam warp let-off motion, is replaced by a computer-controlled or direct pile warp beam let-off motion which is capable of achieving a constant pile feed for plain face-to-face velvet or carpet where this is required for cut velvet and uniform pile height, interrupting the pile warp feed where necessary, in other words, providing only the pile warp feed which is required by the pile weave on each shot. In this way it becomes possible to have each of the three beams in operation with a different pile feed at the same moment. It is also possible to make the pile feed vary in stages or make a gradual increase (positive or negative) during the weaving process. The setting parameters for the pile warp feed are stored in the memory of the microprocessor control system of the weaving machine: pile height per shot, shot density and weave. The pile length produced is scanned and processed in the regulator.

The invention thus relates to a pile feeder and combined ground warp let-off motion, comprising a computer-controlled or a direct pile beam drive which performs both functions, pile feeder and pile warp beam let-off motion, combined directly by means of an intelligent control system of the pile warp let-off motion.

This is achieved by equipping a double-gripper weaving machine with a pile warp beam let-off motion which operates sufficiently accurately and is sufficiently dynamic to ensure that the pile warp is fed to the weaving system without the intervention of any mechanical pile feeder setting.

This pile warp beam let-off motion can be used on 1, 2 and up to 3 pile warp beams, and it can achieve a pile height from 2 mm to 70 mm between top and bottom fabric. The system is capable of calculating the necessary pile warp feed for each operating cycle of the weaving machine. Said pile warp feed is supplied statically and dynamically as a function of the operating cycle of the weaving machine: stop—slow running—fast running—inching operation. The final result is a better quality of fabric which is free from pile warp change stripes. The system can rapidly start and stop pile warp beams up to 1500 mm in diameter, on the one hand, in order to avoid pile height variations during starting/stopping and, on the other hand, in order to avoid pile warp change stripes.

According to the invention, the double-gripper weaving machine also makes it possible to alter the desired pile feed without mechanical changes on the machine. The change-over times of the machine when a new beam is being placed also become shorter, since the pile threads need no longer be passed through the pile feeder system. Moreover, part of the additional cost of the computer-controlled system is recovered through dispensing with the mechanical groups.

These characteristics and other characteristics and special features of the invention will emerge further from the detailed description which follows, with reference to the special drawings, which show an embodiment of the invention by way of example and not in any limited sense.

DESCRIPTION OF THE DRAWINGS

FIG. 3 is a diagrammatic illustration of a mechanical pile feeder with electrically controlled pile beam warp let-off motion according to the prior art;

FIG. 4 is a diagrammatic illustration of the combined pile feeder and pile warp beam let-off motion according to the invention;

DESCRIPTION OF EMBODIMENTS

In these figures the same reference symbols refer to the same or similar elements.

Figure 1:
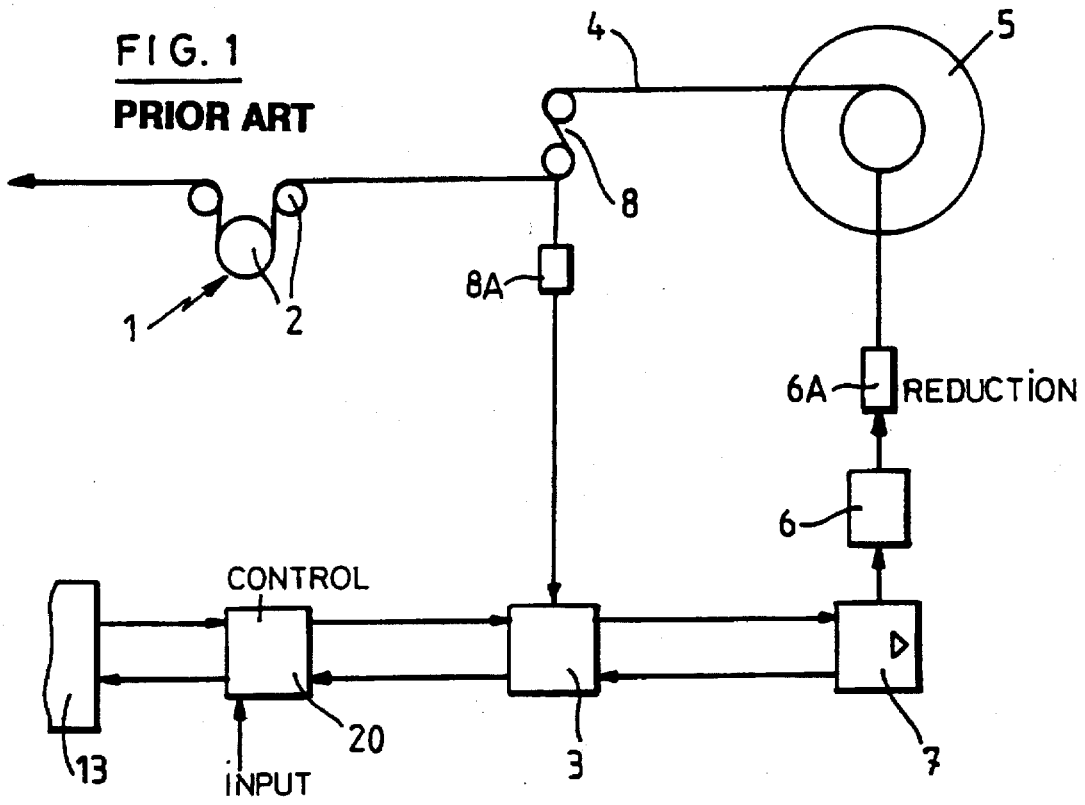
FIG. 1 PRIOR ART
FIG. 1 is a diagrammatic illustration of a mechanical pile feeder with standard electrically controlled pile warp beam let-off motion according to the prior art.

As illustrated in FIG. 1, a pile feeder 1, belonging to the prior art, consists of a set of rollers 2, which are driven by a pile regulator 9.

Until now the quantity of pile yarn 4 used per shot of the weaving machine 13 was set and regulated by means of a mechanical system (the pile regulator 9). The drive of the pile warp beam 5 is by means of a motor 6 and a reduction 6A, the speed of the motor being controlled from a speed regulator 7. Said speed regulator 7 ensures that exactly the same quantity of pile yarn is supplied from the beam 5 as is required by the pile feeder 1. The weaving machine is controlled by a control means 20 receiving setting parameters (input in the drawing), said means 20 sending signals to a speed regulator 3 and receiving signals from said speed regulator 3.

The control system used in FIG. 1 consists of an analog angle recorder 8 with an encoder 8A which passes on data to the speed regulator 3. Said speed regulator 3 sends to and receives signals from the speed regulator 7 of the motor 6.

When a particular design pattern in plain velvet requires little or no pile warp feed, the drive of the pile feeder 2 is interrupted by an electromagnetically controlled gear coupling 9' (see FIG. 3).

Figure 2:
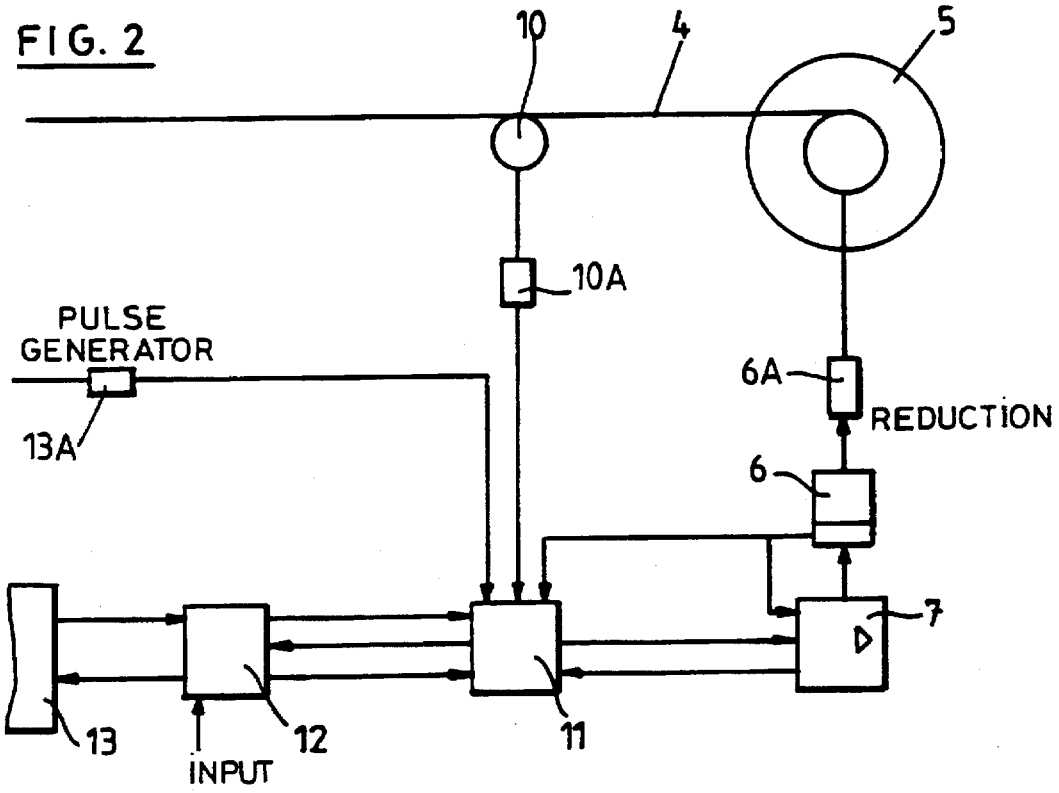
FIG. 2 is a diagrammatic illustration of a pile feeder according to the invention with direct pile beam drive.

FIG. 2 gives a diagrammatic illustration of an embodiment of a computer-controlled pile feeder according to the invention. The whole system of mechanical elements, such as pile feeder 1, pile regulator 9, gear coupling 9' and a pile beam warp let-off motion, is replaced by a computer-controlled pile warp thread let-off motion.

A measuring wheel pulse generator 10 with encoder 10A passes on data to a synchronized control system 11.

The setting parameters (input in the figure) are stored in the memory of a microprocessor control system 12 of the weaving machine 13.

The system 11 receives signals from the pulse generator 13A of the machine, from the encoder 10A, from the microprocessor control system 12, from the motor 6 and from the regulator 7, and sends signals to the microprocessor control system 12 and to the regulator 7. Said regulator 7 receives also a feedback signal from the motor 6.

The drive of the pile warp beam 5 is controlled by the same regulator 7 as that of the already known pile warp let-off motion, but additional accessories are provided:

servo drive 6B;

servomotor 6 with resolver 6C and holding brake 6D (FIG. 4).

Figure 5:
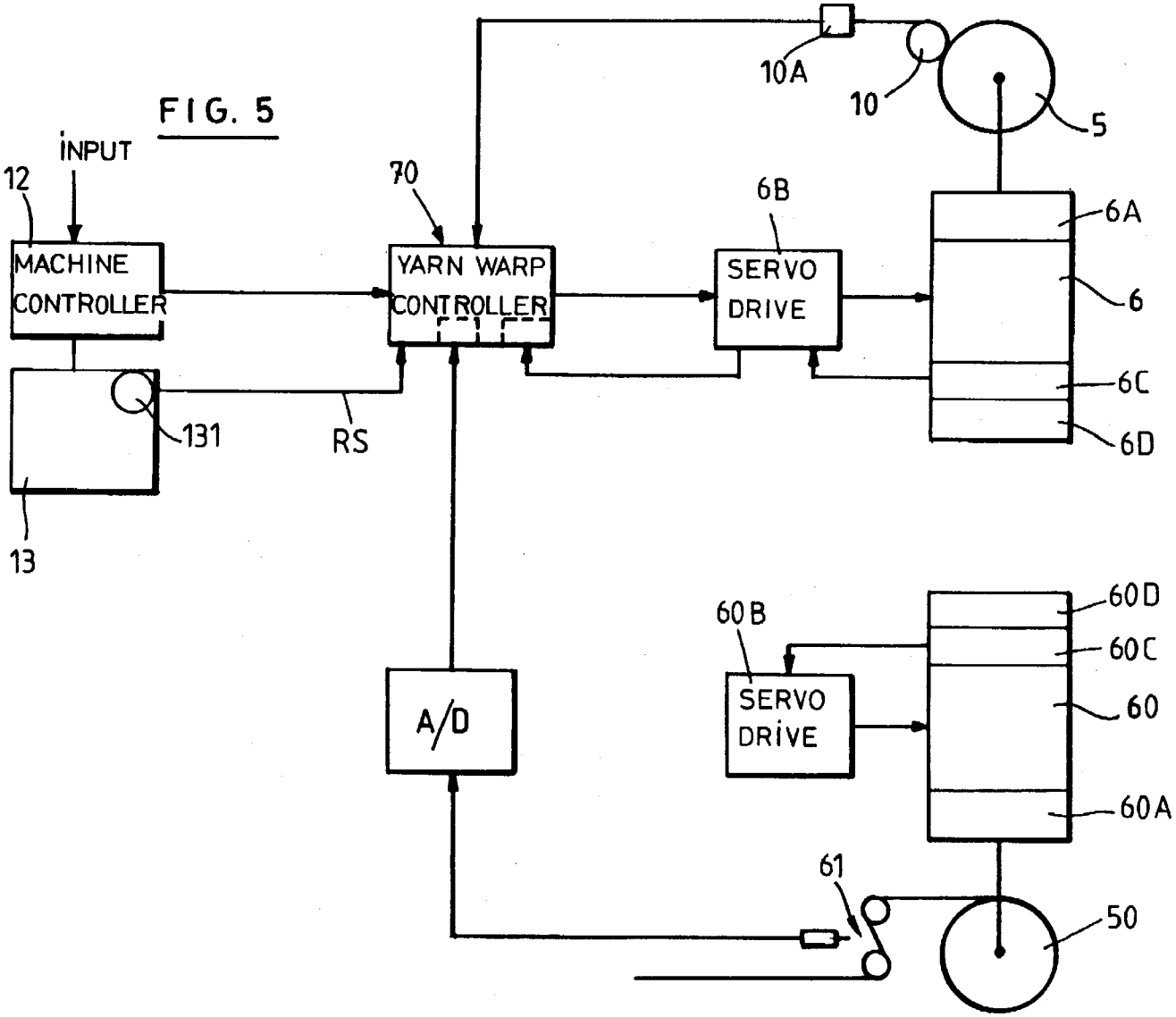
FIG. 5 is a diagrammatic illustration of the functional groups of the combined pile feeder and pile warp beam let-off motion according to FIG. 4, coupled to a drive of a ground warp beam according to the invention.

The drive of the ground warp beam 50 is also controlled by servo drive 60B and servomotor 60 with resolver 60C and handbrake 60D, but the tension in the ground warp is held constant by means of a measuring system consisting of a cam and a linear probe on compensation device 61 (FIG. 5).

Gears 60A (Reduction) are placed between the motor 60 and the beam 50. Advantageously, a protective system on the ground warp tension is also provided.

The control system of FIG. 5 comprises the following modules:

User interface 12 on the weaving machine, in which the desired pile feed can be entered shotwise as a function of the weave to be woven on each shot;

A regulating system 70 on the pile warp beam let-off motion. This regulating system is preferably a multi-axis control system, provided for one or more pile warp beams and preferably for one or more ground warp beams. The regulation of the ground warp beams (max. 2) can be combined in this regulator, with the result that the total cost can be reduced. Since the system must run in synchronism with the main axis of the machine, an axis 131 must be provided in order to constitute a 1/1 (synchronism) reference RS from the weaving machine 13. Since the diameter of the pile beam changes with time, an axis must also be provided per beam for measuring pile warp feed rate;

A four-quadrant servo system consisting of a servodrive with corresponding motor 6 and holding brake 6D, in order to be able to work with intermittent pile feeder operation for each operating cycle of the weaving machine 13;

A reduction gearbox 6A which has a high output. The reduction gearbox is not self-braking and must have low play;

A measuring system 10 to compensate for the varying current beam diameter;

An interface card between the weaving machine control system and the regulator of the beam position. On the one hand, said interface card contains preferbaly a parallel interface with optical division for the control and protection signals of the beam position. On the other hand, a serial interface is preferably provided, in order to be able to override the necessary parameters;

A 1/1 reference signal RS from the machine 13;

Protective system for undertension or overtension;

The regulating circuit of FIG. 5 which comprises:

a speed regulating circuit between servo drive 6B, 60B and servomotor 6, 60;

a high-speed regulating circuit between regulator 70 and motor (via the servo drive 6B) which controls the desired motor speed (measured by means of the resolver 6C on the motor 6, taking into account the reduction ratio 6A and the current beam diameter) as a function of the desired pile feed and the current speed of the machine (measured by means of the resolver on the machine); and a low-speed regulating circuit between the regulator 70 and the motor: the desired motor speed is adapted as a function of the (slowly) changing beam diameter. For this purpose, a measuring wheel 10 with encoder 10A is fitted on the pile beam, so that the current pile feed can be measured. The regulating parameters of the system can also be adapted as a function of the changing beam diameter.

Figure 6:
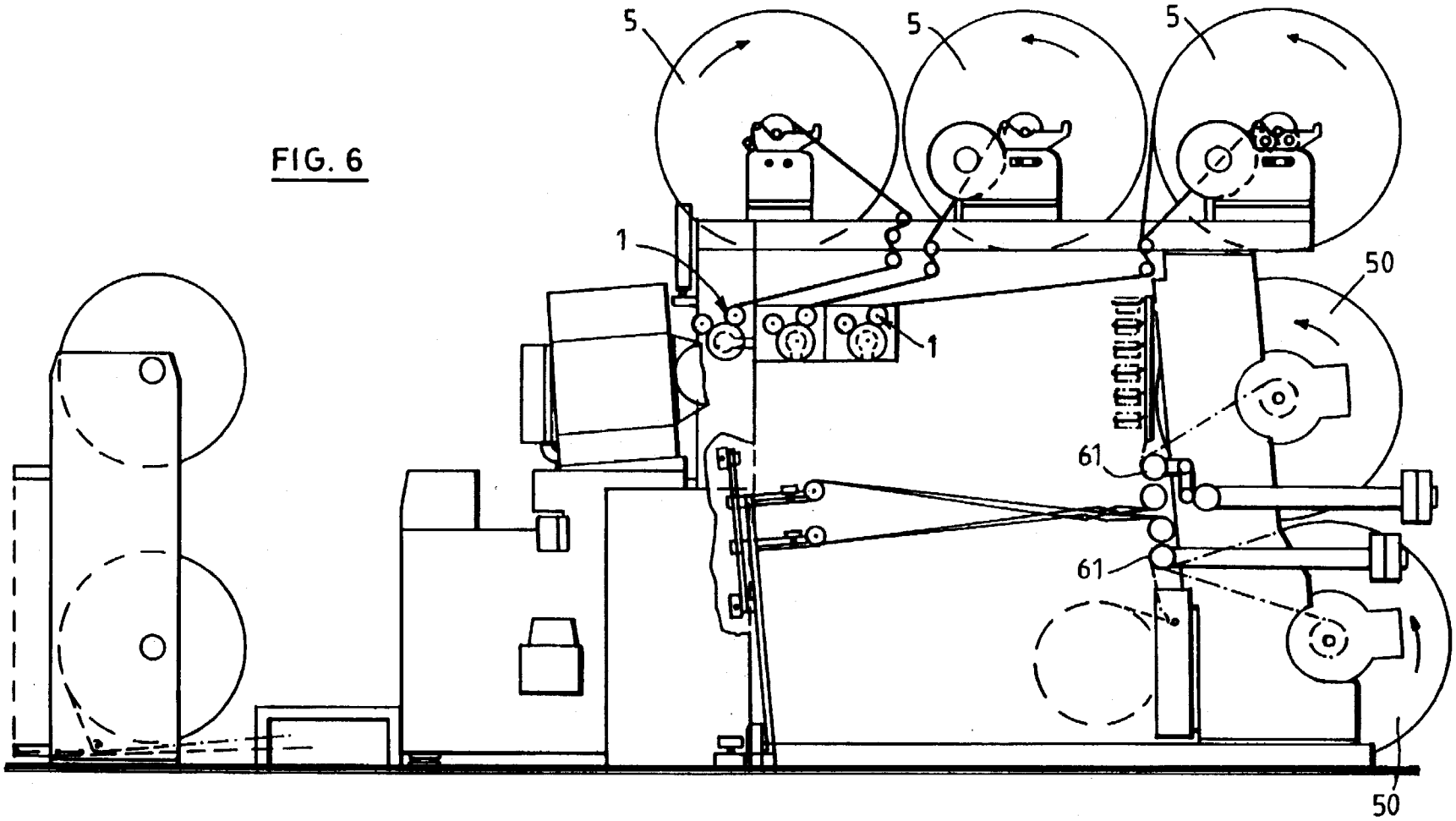
FIG. 6 is a side view of pile and ground warp beam arrangement of a face-to-face weaving machine.

FIG. 6 shows a side view of a pile and ground warp beam arrangement of a face-to-face weaving machine. Situated at the top are three pile warp beams 5 and at the bottom two ground warp beams 50. The position of the mechanical pile feeders is indicated by reference symbol 1.

What I claim is:

1. A pile feeder control system and pile warp let-off motion for a face-to-face weaving machine, for weaving plain velvet and carpets, comprising a pile feeder and a pile warp beam let-off motion equipped with a computer suitable for calculating the necessary pile warp feed rate for each operating cycle of the weaving machine and using said calculation as a reference value, wherein a computer-controlled or a direct pile beam drive directly controls operation of both the pile feeder and pile warp beam let-off motion together, and wherein the pile warp beam let-off motion comprises a regulating system consisting of a multi-axis control system provided for one or more pile warp beams.

2. The system of claim 1, wherein the pile warp beam let-off motion comprises an axis constituting a 1/1 synchronism reference from the weaving machine.

3. The system of claim 1, wherein each beam comprises an axis for measuring the pile warp feed rate.

4. The system of claim 1, wherein the regulating system comprises the following regulating circuits:

a speed regulating circuit between a servo drive and a servomotor;

a high-speed regulating circuit between a regulator and a motor, in order to be able to control the desired motor speed, measured by means of a resolver on the motor and taking into account the reduction ratio and the current beam diameter, as a function of a desired pile feed rate and the current speed of the machine as measured by means of a resolver on the machine; and a low-speed regulating circuit between the regulator and the motor for adopting the desired motor speed as a function of a slowly changing beam diameter, and a measuring wheel, with an encoder, fitted on the pile beam so that the current pile feed rate can be measured.

5. The system of claim 1, wherein ground warp let-off motion is connected to the same multi-axis control system of the pile warp beams.

6. A system for the control of a pile feeder and of the pile warp let-off motion from a pile warp beam in a face-to-face weaving machine, said beam being driven by a motor, said system comprising:

(a) a computer system calculating the necessary pile warp feed rate for each operating cycle of the weaving machine;

(b) a measuring system for measuring the current diameter of the pile warp beam, said system being adapted to send a signal to said computer system;

(c) a regulator for said motor, said regulator being adapted to receive a feedback of said motor and to send a signal to the computer system whereby the computer system comprises:

(a) a low-speed regulating circuit associated with the regulator for controlling the motor speed as a function of the diameter of the pile beam measured by the measuring system, and (b) a high speed regulating circuit associated with the regulator for controlling the motor as a function of a desired pile feed rate and as a function of the weaving speed of the machine.

7. The system of claim 6 further comprising a speed regulating circuit associated with a servo drive and a servomotor for said beam;

wherein said high-speed regulating circuit allows control of a desired motor speed, measured by means of a resolver on the motor and taking into account the reduction ratio and the current beam diameter, as a function of the desired pile feed rate and the current speed of the machine as measured by means of a resolver on the machine; and wherein said low-speed regulating circuit allows control of the desired motor speed as a function of the slowly changing beam diameter, and wherein a measuring wheel, with an encoder, is fitted on the pile beam so that the current pile feed rate can be measured.

8. A face-to-face weaving machine comprising a pile feeder control system and a pile warp let-off motion, wherein a pile feeder and a pile warp beam let-off motion are equipped with a computer for calculating the necessary pile warp feed rate for each operating cycle of the weaving machine and for using said calculation as a reference value, wherein a computer-controlled direct pile beam drive directly controls operation of both the pile feeder and pile warp beam let-off motion together, and wherein the pile warp beam let-off motion comprises a regulating system consisting of a multi-axis control system provided for one or more pile warp beams.

9. The machine of claim 8, wherein the pile warp beam let-off motion comprises an axis constituting a 1/1 synchronism reference from the weaving machine.

10. The machine of claim 8, wherein each pile warp beam comprises an axis for measuring the pile warp feed rate.

11. The system of claim 8, wherein a ground warp let-off motion is connected to said multi-axis control system for the pile warp beams.

* * * * *